US009451378B2

(12) United States Patent
Park

(10) Patent No.: US 9,451,378 B2
(45) Date of Patent: Sep. 20, 2016

(54) METHOD AND APPARATUS TO REPRODUCE MULTI-CHANNEL AUDIO SIGNAL IN MULTI-CHANNEL SPEAKER SYSTEM

(75) Inventor: Hae-kwang Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1471 days.

(21) Appl. No.: 11/845,271

(22) Filed: Aug. 27, 2007

(65) Prior Publication Data

US 2008/0212786 A1 Sep. 4, 2008

(30) Foreign Application Priority Data

Mar. 2, 2007 (KR) ..... 10-2007-0021150

(51) Int. Cl.
*H04R 5/00* (2006.01)
*H04S 3/00* (2006.01)
*H04S 7/00* (2006.01)

(52) U.S. Cl.
CPC ..... *H04S 3/008* (2013.01); *H04S 7/302* (2013.01); *H04S 2420/05* (2013.01)

(58) Field of Classification Search
CPC .... H04S 3/008; H04S 7/302; H04S 2420/05; H04S 3/00; H04S 5/00; H04R 5/02
USPC ..... 381/27, 317, 17, 18, 300, 310, 1, 303, 381/119, 307, 56
See application file for complete search history.

(56) References Cited

U.S. PATENT DOCUMENTS 5,056,149 A 10/1991 Broadie
6,865,430 B1 * 3/2005 Runton et al. ..... 700/94
7,218,740 B1 5/2007 Kowaki
7,369,666 B2 5/2008 Tatsuta et al.
7,443,987 B2 * 10/2008 Griesinger ..... 381/20
7,813,933 B2 * 10/2010 Martin ..... 704/502
2004/0062401 A1 * 4/2004 Davis ..... 381/1
2006/0083383 A1 * 4/2006 Crundwell et al. ..... 381/18
2006/0215853 A1 * 9/2006 Hiruma et al. ..... 381/97

FOREIGN PATENT DOCUMENTS

JP 2000-341800 12/2000
JP 2003-061198 2/2003
JP 2004-040577 2/2004
JP 2006-313980 11/2006
WO 2006-026463 3/2006
WO 2006/057131 A1 6/2006

OTHER PUBLICATIONS

Office action issued in JP 2008-29249 dated Jan. 8, 2013.
Office Action issued in KR Application No. 10-2007-0021150 dated Mar. 26, 2013.
CN Office Action issued Apr. 20, 2011 in CN Application No. 200710168006.X.

* cited by examiner

*Primary Examiner* — Vivian Chin
*Assistant Examiner* — Con P Tran
(74) *Attorney, Agent, or Firm* — Stanzione & Kim, LLP

(57) ABSTRACT

A method and an apparatus to reproduce a multi-channel audio signal, in which mixing of a center channel signal is performed with a center channel signal in a home theater system. The method of reproducing a multi-channel audio signal includes calculating a delay value of a center channel signal according to location relationships of a listener, a center channel speaker and other channel speakers, regulating a time delay of the center channel signal according to the calculated delay value, and mixing the time-delay regulated center channel signal with other channel signals.

22 Claims, 5 Drawing Sheets

METHOD AND APPARATUS TO REPRODUCE MULTI-CHANNEL AUDIO SIGNAL IN MULTI-CHANNEL SPEAKER SYSTEM

CROSS-REFERENCE TO RELATED APPLICATIONS

This application claims the benefit of Korean Patent Application No. 10-2007-0021150, filed on May 2, 2007, in the Korean Intellectual Property Office, the disclosure of which is incorporated herein in its entirety by reference.

BACKGROUND OF THE INVENTION

1. Field of the Invention

The present general inventive concept relates to a multi-channel speaker system, and more particularly, to a method and an apparatus to reproduce a multi-channel audio signal that performs mixing of a signal of a center channel to left and right channels in a home theater system.

2. Description of the Related Art

Recently, home theater systems have been developed and launched. Home theater systems reproduce video and audio that are recorded in various recording media such as DVDs, HDDs, tapes or the like and output the video reproduced from the recording media onto wide screen televisions.

In addition, home theater systems separate and output audio channels of audio reproduced from recording media, for example, multi-channel audio of 5.1 channel surround sound that is reproduced from DVD through six speakers that are separated and equipped at different locations.

In addition, home theater systems simply perform mixing of audio signals of left and right channels and output the audio signals of the left and right channels as an audio signal of a center channel.

However, in home theater systems, speech cannot sometimes be clearly conveyed to a listener due to the volume of the center channel, locations of speakers, a difference in speaker units or the like.

FIG. 1 is a conceptual view illustrating an effect of a time-delayed signal, which occurs according to a listener's location in conventional mixing of a center sound.

When two sounds having the same frequency and sound pressure are simultaneously reproduced through two speakers in a conventional stereo system, the two sounds sound like a sound generated from the front center with respect to human ears. Likewise, when a sound image is positioned in the front center of speakers, it is said that 'a sound image is localized. The localization of the sound image is determined according to level, phase and time differences between each of the left and right speakers and a listener. When the same sounds are heard in different directions after a certain interval, a last sound is masked by a first sound. Accordingly, the listener can hear in a direction of a sound source of the first sound. This phenomenon is known as a "precedence effect," "Haas effect" or "first front wave law."

Referring to FIG. 1, two speakers SL and SR are arranged at left and right sides, and a listener is positioned in the front center of the two speakers. A sound signal is directly input to the left speaker SL, and a sound delayed by a time $\tau d$ is input to the right speaker SR. When the delayed time difference $(\tau d)=0$ ms, that is, when left and right signals simultaneously arrive at the ears of the listener, the sound image is positioned in the center A of the two speakers SL and SR. As the delayed time difference $\tau d$ gradually increases, the left signal arrives more quickly at the ears of the listener than the right signal, and the sound image is gradually moved towards a left side. A moving degree of the sound image is gradually changed according to the type of sound source and the listener's location. However, the sound image is moved in proportion to the time difference $\tau d$ towards each speaker from the center of the speakers at a time difference of less than 1 ms. The sound image sounds as if a sound is output from only one speaker at a time difference in the range of 1 to 30 ms.

Accordingly, when a listener is closer to one speaker than other speakers, a center sound, on which mixing is performed, may be heard from only one speaker, which is closest to a listener, using a conventional mixing manner of a center sound.

SUMMARY OF THE INVENTION

The present general inventive concept provides a method and apparatus to reproduce a multi-channel audio signal on which mixing is performed with respect to left and right channels by reflecting a time delay according to a location of a speaker with respect to a signal of a center channel in a home theater system.

The present general inventive concept also provides a multi-channel speaker system in which a method and an apparatus for reproducing multi-channel audio signals.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of reproducing a multi-channel audio signal including calculating a delay value of a center channel signal according to location relationships of a listener, a center channel speaker and other channel speakers, regulating a time delay of the center channel signal according to the calculated delay value, and mixing the time-delay regulated center channel signal with other channel signals.

The foregoing and/or other aspects and utilities of the present general inventive concept may also be achieved by providing an apparatus to reproduce a multi-channel audio signal, the apparatus including a delay unit to time-delay a signal of a center channel according to a delay value of the center channel, which is calculated according to location relationships of a listener, a center channel speaker and other channel speakers, a mixing gain unit to regulate a gain of a center channel signal by providing a gain value, which is already set, to the time-delayed center channel signal, and a mixing unit to mix the signal of the center channel, on which the time delay is performed and a gain is regulated, with signals of other channels.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
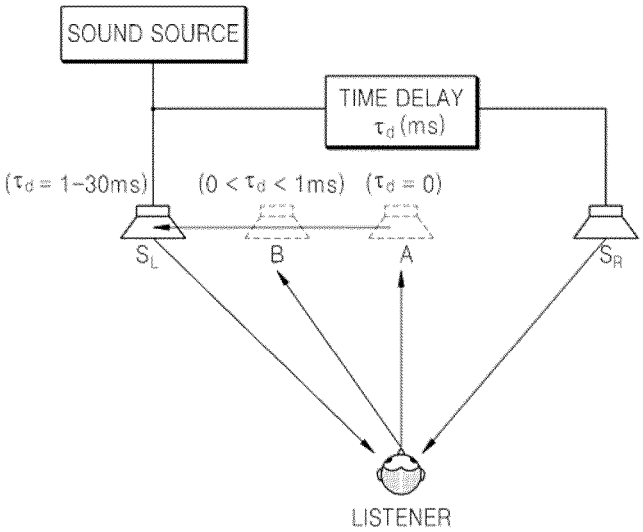
FIG. 1 (RELATED ART)
FIG. 1 is a conceptual view illustrating an effect of a time-delayed signal, which occurs according to a listener's location in conventional mixing of a center sound.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
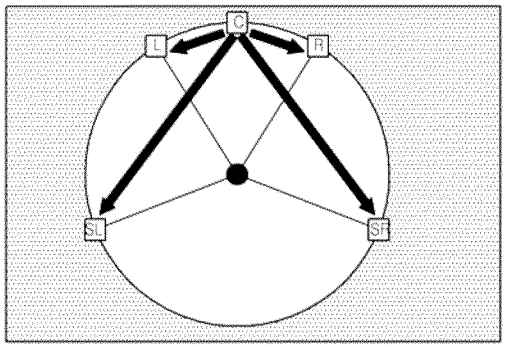
FIG. 2 is a conceptual view of a method of reproducing a multi-channel signal according to an embodiment of the present general inventive concept.

FIG. 2 is a conceptual view of a method of reproducing a multi-channel signal according to an embodiment of the present general inventive concept.

Referring to FIG. 2, assuming that 5-channel audio is input, there are five speakers with respect to a listener, including a left channel L, a right channel R, a center channel C, a left surround channel SL and a right surround channel SR.

At this time, mixing is performed between an audio signal of the center channel C and audio signals of the left channel L and the right channel R. In addition, mixing is performed between the audio signal of the center channel C and audio signals of the left surround channel SL and the right surround channel SR.

Figure 3:
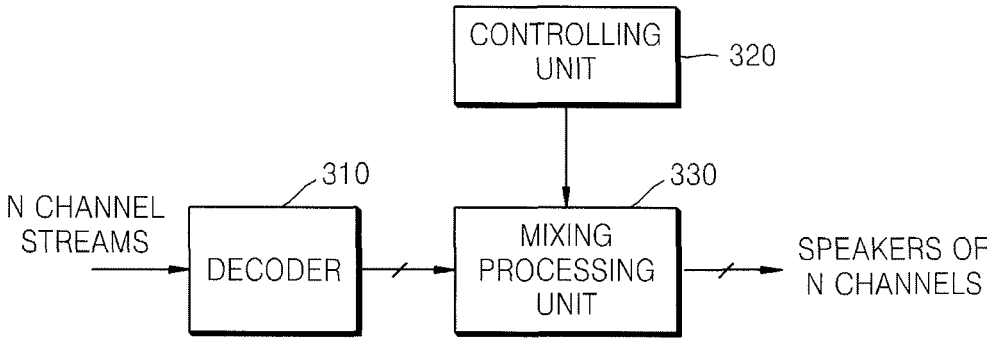
FIG. 3 is a block diagram of a multi-channel speaker system according to an embodiment of the present general inventive concept.

FIG. 3 is a block diagram of a multi-channel speaker system according to an embodiment of the present general inventive concept.

Referring to FIG. 3, the multi-channel speaker system includes a decoder 310, a controlling unit 320 and a mixing processing unit 330.

The decoder 310 separates N channel audio bit streams input from a signal reproducer into audio signals having N channels (e.g. a left channel L, a right channel R, a center channel C, a left surround channel SL and a right surround channel SR).

The controlling unit 320 recognizes locations of the listener and a speaker of each channel, and calculates a delay value of a signal of the center channel C according to location relations of the listener, a center channel speaker and another channel speaker. Since methods of recognizing a location are well known to one of ordinary skill in the art, the embodiments herein are not limited to a specific method. As an example, the locations of the listener and the speaker can be recognized by using a camera or an ultrasonic sensor. The delay value is calculated using a processing method including calculating a signal delay and a signal sound pressure level difference between a center channel speaker and another channel speaker, calculating a distance for which a sound image of a center channel is moved from the center of the two speakers, setting a threshold from a sound pressure level difference between two channel speakers, and converting a distance between a listener and each of two speakers into the delay value within the threshold. At this time, the delay value is a parameter that can localize a signal of a center channel to the location of the center speaker irrespective of a change in the listener's location.

The mixing processing unit 330 regulates a time delay of the center channel signal separated by the decoder 310 according to the delay value calculated by the controlling unit 320, and performs mixing the signal of the center channel with the signals of another channel separated by the decoder 310 by providing a mixing gain value that is already set to the center channel of which a time delay is regulated.

Figure 4:
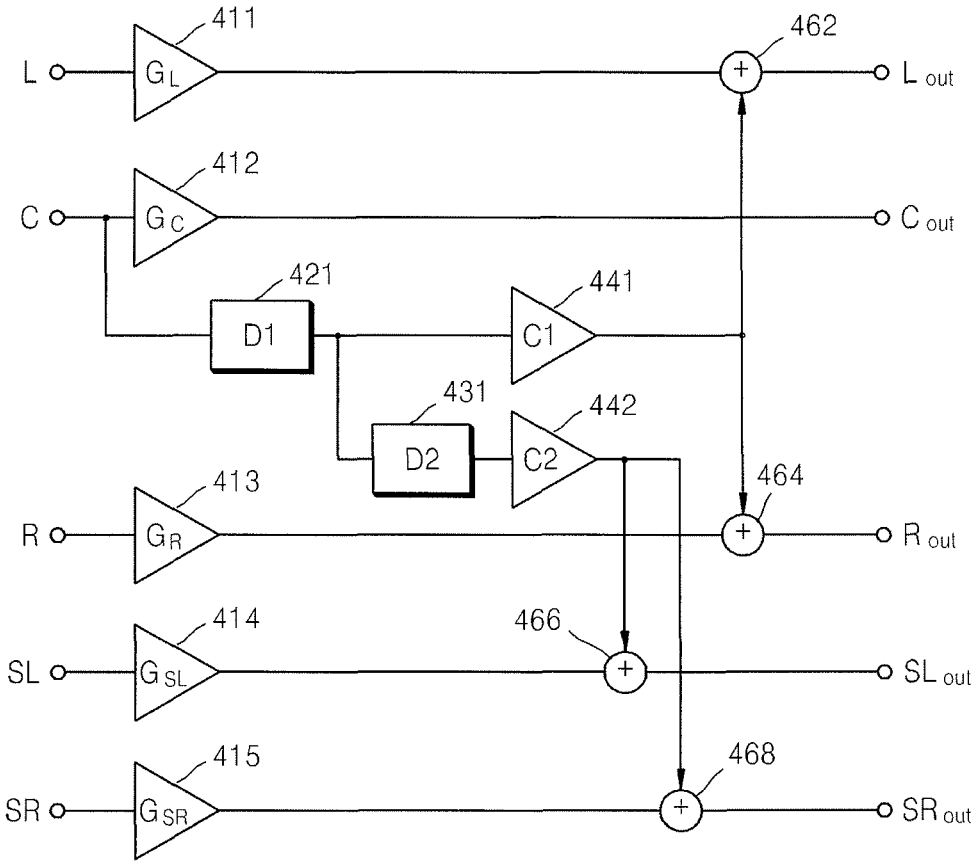
FIG. 4 is a view of the mixing processing unit 330 illustrated in FIG. 3.

FIG. 4 is a view of the mixing processing unit 330 illustrated in FIG. 3.

Referring to FIG. 4, first, second, third, fourth and fifth gain units 411, 412, 413, 414 and 415 respectively regulate gains of a left channel L signal, a right channel R signal, a center channel C signal, a left surround channel SL signal and a right surround channel RL signal. That is, the gain of the left channel L signal is changed by a gain value $G_L$ of the first gain unit 411. The gain of the center channel C signal is changed by a gain value $G_C$ of the second gain unit 412. The gain of the right channel R signal is changed by a gain value $G_R$ of the third gain unit 413. The gain of the left surround channel SL signal is changed by a gain value $G_{SL}$ of the fourth gain unit 414. The gain of the right surround channel SR signal is changed by a gain value $G_{SR}$ of the fifth gain unit 415.

A first delay unit 421 reflects a delay value D1 according to the locations of speakers in order to delay the center channel C signal for a predetermined period of time.

A first mixing gain unit 441 provides a fixed gain value C1 to the center channel C signal that is delayed in the first delay unit 421 in order to perform mixing between the center channel C signal and each of the left and right channel L and R signals.

A second delay unit 431 reflects a delay value D2 according to the locations of speakers to delay the center channel C signal that is delayed in the first delay unit 421 for a predetermined period of time.

A second mixing gain unit 442 provides a fixed gain value C2 to the center channel C signal that is delayed in the second delay unit 431 in order to perform mixing between the center channel C signal and each of the left and right surround channel L and R signals.

A first mixing unit 462 performs mixing between the left channel L signal output by the first gain unit 411 and the center channel C signal output by the first mixing gain unit 441.

A second mixing unit 464 performs mixing between the right channel R signal output by the third gain unit 413 and the center channel C signal output by the first mixing gain unit 441.

A third mixing unit 466 performs mixing between the left surround channel L signal output by the fourth gain unit 414 and the center channel C signal output by the second mixing gain unit 442.

A fourth mixing unit 468 performs mixing between the right surround channel R signal output by the fifth gain unit 415 and the center channel C signal output by the second mixing gain unit 442.

Figure 5:
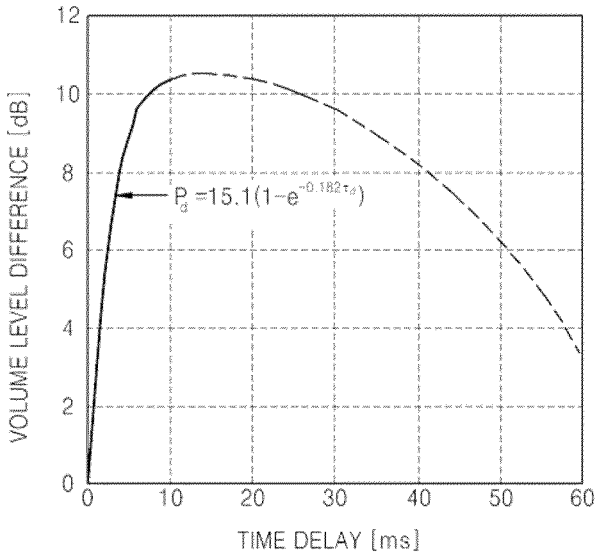
FIG. 5 is a graph illustrating a common Haas effect in terms of equations.

FIG. 5 is a graph illustrating a common Haas effect in terms of equations.

Referring to FIG. 5, an X-axis represents a time delay, and a Y-axis represents a volume level difference. That is, the graph illustrated in FIG. 5 illustrates the relationship between the time delay and the volume level difference. In addition, modeling can be performed with respect to the relationship between the time delay and the volume level difference in terms of equations, within a time delay of 60 ms. Accordingly, a sound pressure difference $P_d$ calculated by modeling is given by Equation 1 below.

$$P_d=15.1(1-e^{-0.182\tau d}) \quad \text{Equation 1}$$

For example, referring to FIG. 5, when the time delay is 5 ms, a volume level difference should be maintained at 7.5 dB.

Figure 6A:
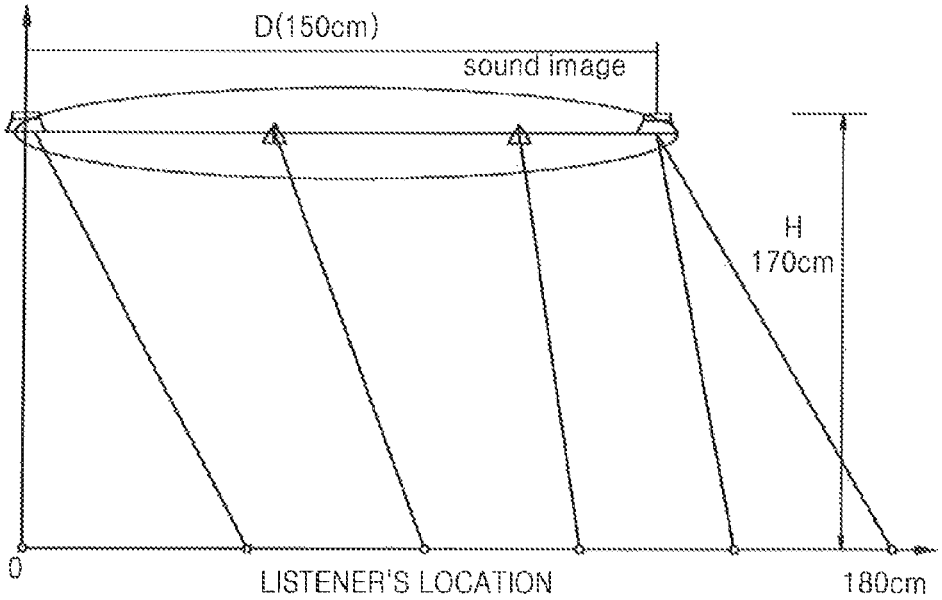
FIGS. 6A and 6B are arrangement views to calculate movement and orientation of a sound image according to a listener's location when a right speaker and a center speaker are used, according to an embodiment of the present general inventive concept.
Figure 6B:
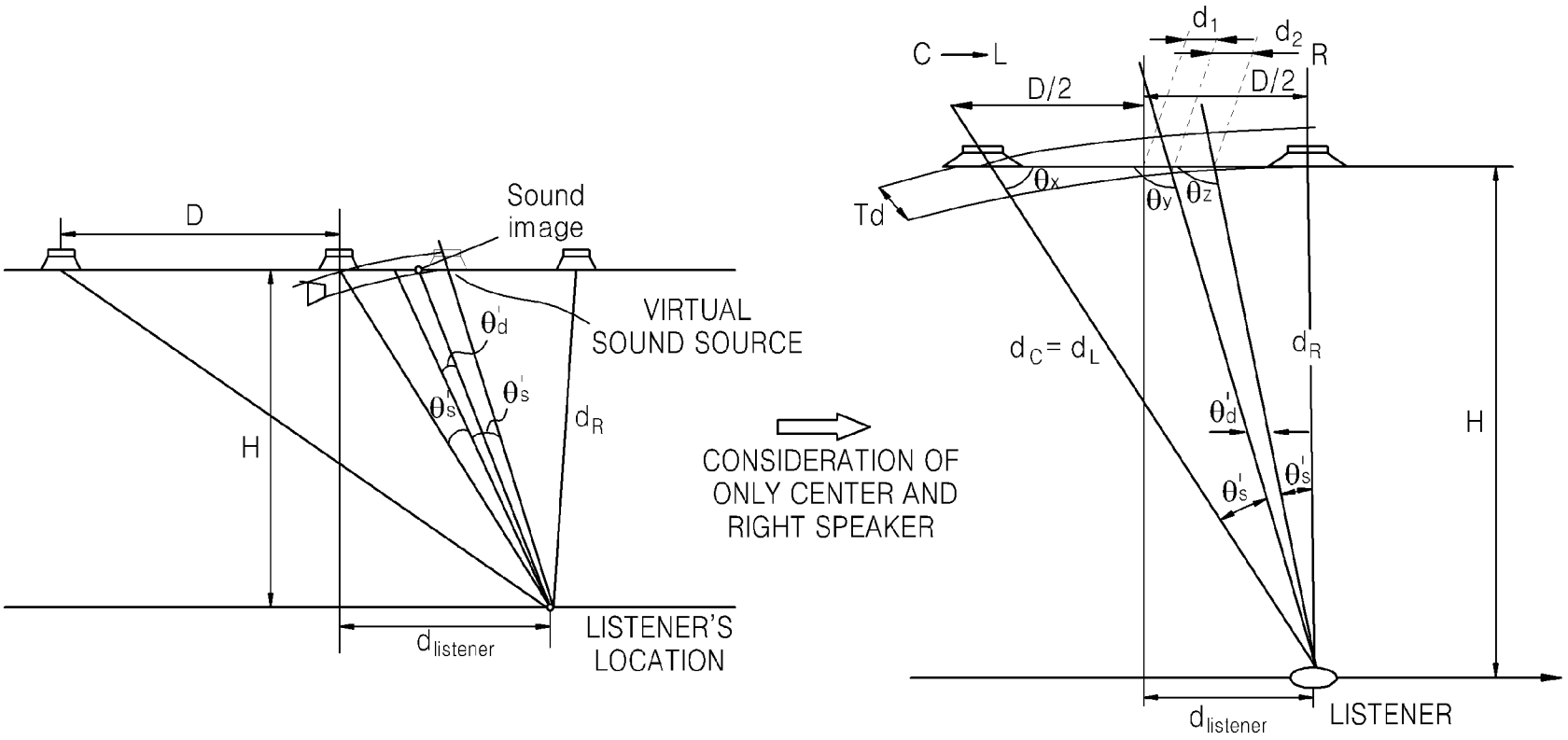

FIGS. 6A and 6B are arrangement views to calculate movement and orientation of a sound image according to a listener's location when a right speaker and a center speaker are used, according to an embodiment of the present general inventive concept.

Referring to FIGS. 6A and 6B, an operation of setting the delay value and the gain value as illustrated in FIG. 4 will be described.

First, when the listener moves towards the right from a front center position (a location of a center speaker), a sound image of the center speaker is gradually moved, as illustrated in FIG. 6B. A distance $d_R$ between the listener and the right speaker and a distance $d_C$ between the listener and the center speaker are respectively given by Equations 2 and 3 below. Here, $d_{listener}$ is a moving distance of the listener, H is a distance between the listener and the speaker, and D is a distance between speakers.

$$d_R=\sqrt{(H)^2+(D/2-d_{\text{listener}})^2} \quad \text{Equation 2}$$

$$d_C=\text{sqrt}[(H)^2+(D/2+d_{listener})^2] \quad \text{Equation 3}$$

A distance difference $d_{diff}$ is given by Equation 4 using $d_R$ and $d_C$.

$$d_{diff}=d_C-d_R \quad \text{Equation 4}$$

In addition, when the distance difference $d_{diff}$ is converted into a time difference $t_{diff}$, the conversion is given be Equation 5. Here, $v_s$ is about 340 m/s which is the propagation velocity of a sound wave.

$$t_{diff}=d_{diff}/v_s \quad \text{Equation 5}$$

When modeling is performed with respect to the relationship between the time delay and the volume level difference in terms of equations, within a time difference of 60 ms, the relationship is given by Equation 1. A sound pressure level difference $P_D$ according to a distance ratio between the listener and each of the left and right speakers is given by Equation 6.

$$P_D=20\log(d_R/d_C) \quad \text{Equation 6}$$

Accordingly, a total sound pressure level difference $P_t$ is given by Equation 7. Here, $P_H$ is a sound pressure level difference according to a level ratio of a signal.

$$P_t=P_H+P_D \quad \text{Equation 7}$$

Meanwhile, a sound pressure level difference k between the left and right speakers, which is obtained using linear scale, is given by Equation 8.

$$k=10^{Pt/20} \quad \text{Equation 8}$$

Referring to FIG. 6B, when a sound pressure level of both ears are the same in the listener's location, a sound image exists in the center of an angle between the two speakers viewed from the listener's location.

The two angle $\theta'_s$ between the two speakers, between which the sound image exists, can be given by Equation 9.

$$\theta'_s=\frac{1}{2}\cos^{-1}\left(\frac{d_R^2+d_C^2-D^2}{2\times d_R\times d_C}\right) \quad \text{Equation 9}$$

In FIG. 6B, angles $\theta_x$, $\theta_y$ and $\theta_z$, which are used to calculate a distance $d_1$ in which the sound image is moved from the center of the two left and right speakers, can be given by Equations 10, 11 and 12, respectively.

$$\theta_x=\cos^{-1}\left(\frac{d_C^2+D^2-d_R^2}{2\times d_C\times D}\right) \quad \text{Equation 10}$$

$$\theta_y=180-\theta'_s-\theta_x \quad \text{Equation 11}$$

$$\theta_z=180-(180-\theta_y)-\theta'_d \quad \text{Equation 12}$$

Accordingly, a distance $d_1$, in which the sound image is moved from the center of the two speakers, is given be Equation 13.

$$d_1=d_L\frac{\sin\theta'_s}{\sin\theta_y}-D/2 \quad \text{Equation 13}$$

A sound image direction $\theta'_d$ that is calculated in the listener's location according to the sound pressure level difference k of the left and right speakers is given by Equation 14 with respect to the angle $\theta'_s$ between the two speakers where the sound image exists.

$$\theta'_d=\sin^{-1}\left(\frac{1-k}{1+k}\sin\theta'_s\right) \quad \text{Equation 14}$$

When the sound image is moved a distance $d_2$ according to the sound image direction $\theta'_d$ with respect to the distance $d_1$, a distance $d_t$, which a center sound image is moved from the center of the two speakers, is given by Equation 15.

$$d_t=d_1+d_2 \quad \text{Equation 15}$$

If a center channel signal level, on which mixing is performed with respect to another channel signal, is the same or smaller than a signal level that is reproduced by the center channel speaker, the distance difference $d_{diff}$ given by Equation 4 may be a negative enough value in order to prevent the sound image of the center speaker from moving.

Assuming that a distance difference between the two speakers is within 5 m, according to listening circumstances of a conventional home theater system, when a level of the center channel signal on which mixing is performed is smaller than a signal that is reproduced in the center speaker, the center sound can be prevented from being moved so as to have a time difference of 6 ms or more according to the Haas effect illustrated in FIG. 5. Here, the distance which the sound image is moved, can be given with respect to the time difference $t_{diff}$ using Equation 5. Accordingly, the delay value D1 of the first delay unit 421 illustrated in FIG. 4 may be set as 6 ms or more in order to prevent the sound image of the center sound from moving.

In addition, when the localization of the sound image, which is performed by mixing of the surround channel, the center channel and the front channel, is interpreted in the same manner, a time difference of about 5 ms is required for the surround channel with respect to the front channel. Accordingly, the delay value D2 of the second delay unit 431 illustrated in FIG. 4 may be determined as the delay value D1+5 ms. For the Haas effect, the delay value D1 may be determined as a value in the range of 5 to 15 ms.

Mixing gains $C_1$ and $C_2$ may be determined so that gains of the center channel signal and another channel signal do not differ greatly.

Equations 16 and 17 below are two examples of equations that are used to determine the mixing gains $C_1$ and $C_2$. Here, $\alpha$ is determined as a constant of 1 or less. When $\alpha$ is about 0.7, the volumes of the center channel, on which mixing is performed and the original center channel are similar. In addition, Equation 17 is an example of determining a mixing gain when the mixing gain $C_2$ is 0. $\beta$ is determined as a constant of 1 or less.

$$\begin{aligned} Cout &= [1-\alpha]C \\ Lout &= [1-\alpha]L+\alpha C \\ Rout &= [1-\alpha]R+\alpha C \\ SLout &= [1-\alpha]SL+\alpha C \\ SRout &= [1-\alpha]SR+\alpha C \end{aligned} \quad \text{Equation 16}$$

$$\begin{aligned} Cout &= [1-\beta]C \\ Lout &= [1-\beta]L+\beta C \\ Rout &= [1-\beta]R+\beta C \\ SLout &= [1-\beta]SL \\ SRout &= [1-\beta]SR \end{aligned} \quad \text{Equation 17}$$

The embodiment herein can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to the embodiments as described above, tone heterogeneity due to a poor location of a center speaker and a difference in speaker units can be overcome, and articulation of a speech can be improved using a new center channel mixing method without reducing a multi-channel effect. In addition, the present general inventive concept is more effective in a common dwelling environment in which volume cannot be freely increased. The volume reproduced using the embodiments herein is the same value as the sum in terms of energy of a sound that arrives to the ears of a listener and a sound that is delayed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of reproducing a multi-channel audio signal, the method comprising:

obtaining a delay value of a center channel signal according to relative locations of a listener, a center channel speaker and other channel speakers with respect to each other, wherein the obtaining of the delay value includes:

calculating a distance in which a sound image of the center channel is moved from a center of the center channel speaker in a direction of a right or a left channel speaker by calculating a distance of the listener to the center channel speaker and a distance of the listener to the right channel speaker when the sound image of the center channel is moved from the center of the center channel speaker in the direction of the left channel speaker or calculating a distance of the listener to the center channel speaker and a distance of the listener to the left channel speaker when the sound image of the center channel is moved from the center of the center channel speaker in the direction of the right channel speaker, calculating a sound pressure level difference between the center channel speaker and one of the right channel speaker and the left channel speaker based on the direction of the sound image movement;

setting the sound pressure level difference according to the distance which the sound image of the center channel is moved, as a threshold value, and converting a distance difference between the listener, and the center channel speaker and between the listener and one of the right channel speaker and the left channel speaker based on the direction of the sound image movement into the delay value within the threshold value;

regulating a time delay of the center channel signal according to the obtained delay value; and mixing the time-delay regulated center channel signal with other channel signals.

2. The method of claim 1, wherein the distance difference between the listener, the center channel speaker and the right channel speaker is a difference value of a distance between the listener and the center channel speaker and a distance between the listener and the right channel speaker.

3. The method of claim 1, further comprising:

providing a gain value, which is already set, to the signal of the center channel that is time-delay regulated.

4. The method of claim 1, wherein the mixing comprises:

time-delaying the center channel signal according to a set delay value, and mixing the time-delayed center channel signal with left and right channel signals.

5. The method of claim 1, wherein the sound pressure difference is based on a distance ratio between the center channel speaker and each of the other channel speakers.

6. The method of claim 1, wherein the obtaining of the delay value includes:

calculating the distance $d_1$ in which the sound image of the center channel is moved from the center of the center channel speaker in the direction of the right channel speaker so as to satisfy $$d_1 = d_L \frac{\sin\theta'_s}{\sin\theta_y} - D/2,$$

when the center channel speaker becomes the left channel speaker and $d_L = d_C$, where $\theta'_s$ is defined as $$\theta'_s = \frac{1}{2}\cos^{-1}\left(\frac{d_R^2 + d_C^2 - D^2}{2 \times d_R \times d_C}\right),$$

$\theta_y$ is defined as $$\theta_y = 180 - \theta'_S - \cos^{-1}\left(\frac{d_C^2 + D^2 - d_R^2}{2 \times d_c \times D}\right),$$

$d_L$ is a distance between the listener and the center of the center channel speaker, D is a distance between the center channel speaker and the left channel speaker, and D is also the distance between the center channel speaker and the right channel speaker, $d_R$ is a distance between the listener and the right channel speaker, $d_C$ is a distance between the listener and the center channel speaker, and a distance difference $d_{diff}$ is given by $d_{diff}=d_C-d_R$, and $t_{diff}=d_{diff}/v_s$, where $t_{diff}$ is a time difference and $v_s$ is a propagation velocity of a sound wave in air.

7. A method of reproducing a multi-channel audio signal comprising at least a center channel and another channel, the method comprising:

setting a delay value of the center channel signal according to a signal delay and a sound level difference of the center channel speaker and a right channel speaker, a distance $d_1$ in which a sound image of the center channel is moved from a center of the center channel speaker in a direction of the right channel speaker so that calculating the distance $d_1$ is converted to calculating a distance of the listener to the center channel speaker as a distance of the listener to a left channel speaker;

calculating a signal delay and a sound level difference between the center channel speaker and the right channel speaker;

setting a sound pressure difference between the center channel speaker and each of the other channel speakers, the sound pressure difference being based on a distance ratio between the center channel speaker and each of the other channel speakers;

converting a distance difference between the listener, the center channel speaker and the right channel speaker into a signal delay value within the threshold value;

time-delaying the center channel signal according to the delay value, gain-regulating the center channel signal according to a predetermined gain value, and mixing the signal of the center channel and left and right front channels; and time-delaying the center channel signal, which is already time-delayed in the above time-delaying operation, according to a predetermined delay value, gain-regulating the center channel signal according to predetermined gain value, and mixing the center channel signal and the left and right surround channels.

8. The method of claim 7, wherein setting the delay value of the center channel signal according to the signal delay and the sound level difference between the center channel speaker and the right channel speaker, where the distance $d_1$ in which the sound image of the center channel is moved from the center of the center channel speaker in the direction of the right channel speaker is calculated by $$d_1 = d_L\frac{\sin\theta'_s}{\sin\theta_y} - D/2,$$

when the center channel speaker becomes the left channel speaker and $d_L=d_C$, where $\theta'_s$ is defined as $$\theta'_s = \frac{1}{2}\cos^{-1}\left(\frac{d_R^2 + d_C^2 - D^2}{2 \times d_R \times d_C}\right),$$

$\theta_y$ is defined as $$\theta_y = 180 - \theta'_s - \cos^{-1}\left(\frac{d_C^2 + D^2 - d_R^2}{2 \times d_C \times D}\right),$$

$d_L$ is a distance between a listener and the center of the center channel speaker, D is a distance between the center channel speaker and the left channel speaker, and D is also the distance between the center channel speaker and the right channel speaker, $d_R$ is a distance between the listener and the right channel speaker and $d_C$ is a distance between the listener and the center channel speaker, and a sound pressure difference between the center channel speaker and each of the other channel speakers, the sound pressure difference being based on a distance ratio between the center channel speaker and each of the other channel speakers, and a distance difference $d_{diff}$ is given by $d_{diff}=d_C-d_R$, and $t_{diff}=d_{diff}/v_s$, where $t_{diff}$ is a time difference and $v_s$ is a propagation velocity of a sound wave in air.

9. An apparatus to reproduce a multi-channel audio signal, the apparatus comprising:

a delay device configured to receive a signal of a center channel and to time-delay the signal of the center channel according to a delay value of the center channel, which is calculated according to location relationships of a listener, a center channel speaker and other channel speakers, the time-delaying of the signal including calculating a distance $d_1$ in which a sound image of the center channel is moved from a center of the center channel speaker in a direction of a right channel speaker so that calculating the distance $d_1$ is converted to calculating a distance of the listener to the center channel speaker as a distance of the listener to a left channel speaker;

calculating a signal delay and a sound level difference between the center channel speaker and the right channel speaker;

setting a sound pressure difference between the center channel speaker and each of the other channel speakers according to the distance which the sound image of the center channel is moved, as a threshold value;

converting a distance difference between the listener, the center channel speaker and the right channel speaker into a signal delay value within the threshold value;

a mixing gain device configured to receive the time-delayed center channel signal and to regulate a gain of the center channel signal by providing a gain value, which is already set, to the time-delayed center channel signal; and a mixing device configured to receive and mix the signal of the center channel, on which the time delay is performed and the gain is regulated, with signals of other channels.

10. The apparatus of claim 9, wherein the delay device configured to receive the signal of the center channel and to time-delay the signal of the center channel according to the delay value of the center channel, is calculated according to location relationships of the listener, the center channel speaker and other channel speakers, the time-delaying of the signal including calculating the distance $d_1$ in which the sound image of the center channel is moved from the center between the center channel speaker in the direction of a right channel speaker so as to satisfy $$d_1 = d_L \frac{\sin\theta'_s}{\sin\theta_y} - D/2,$$

when the center channel speaker becomes the left channel speaker and $d_L = d_C$,
where $\theta'_s$ is defined as $$\theta'_s = \frac{1}{2}\cos^{-1}\left(\frac{d_R^2 + d_C^2 - D^2}{2 \times d_R \times d_C}\right),$$

$\theta_y$ is defined as $$\theta_y = 180 - \theta'_s - \cos^{-1}\left(\frac{d_C^2 + D^2 - d_R^2}{2 \times d_C \times D}\right),$$

$d_L$ is a distance between the listener and the center of the center channel speaker, D is a distance between the center channel speaker and the left channel speaker, and D is the distance between the center channel speaker and the right channel speaker, $d_R$ is a distance between the listener and the right channel speaker and $d_C$ is a distance between the listener and the center channel speaker, wherein the delay value is determined from a difference value of a distance between the listener and the center channel speaker and a distance between the listener and the right channel speaker, and from a sound pressure difference between the center channel speaker and each of the other channel speakers, and a distance difference $d_{diff}$ is given by $d_{diff} = d_C - d_R$ and $t_{diff} = d_{diff}/v_s$, where $t_{diff}$ is a time difference and $v_s$ is a propagation velocity of a sound wave in air.

11. A multi-channel speaker system comprising:

a decoder to separate a plurality of channel audio bit streams to audio signals having a plurality of channels;

a control device configured to receive the audio signals having the plurality of channels, to recognize locations of a listener and each channel and to calculate a delay value of a center channel signal according to location relationships of the listener, a center channel speaker and other channel speakers, the calculating of the delay value including calculating a distance $d_1$ in which a sound image of the center channel is moved from a center of the center channel speaker in a direction of a right channel speaker so that calculating the distance $d_1$ is converted to calculating a distance of the listener to the center channel speaker as a distance of the listener to a left channel speaker, to calculate a signal delay and a sound level difference between the center channel speaker and the right channel speaker, to set a sound pressure difference between the center channel speaker and each of the other channel speakers according to the distance which the sound image of the center channel is moved, as a threshold value, and to convert a distance difference between the listener, the center channel speaker and the right channel speaker into a signal delay value within the threshold value; and a mixing processing device configured to receive the delay value calculated by the control device and the center channel signal and other channel signals separated by the decoder, to regulate a time delay of the center channel signal according to the delay value calculated by the control device, and to mix the center channel signal with other channel signals separated by the decoder by providing a mixing gain value, which is already set, to the center channel signal that is time-delay regulated.

12. The system of claim 11, wherein the mixing processing device comprises:

a delay device configured to perform time delay of the center channel signal according to the delay value;

a mixing gain device configured to regulate a gain of the center channel signal by providing a gain value, which is already set, to the center channel signal time-delayed by the delay device; and a mixing device configured to mix the signal, which is time-delayed and gain-regulated, to other channel signals.

13. The system of claim 12, wherein the delay device comprises:

a first delay device configured to reflect a first delay value according to locations of the channel speakers in order to delay the center channel signal for a predetermined period of time; and a second delay device configured to reflect a second delay value according to locations of the channel speakers to delay the center channel signal that is delayed in the first delay device.

14. The system of claim 13, wherein the mixing gain device comprises:

a first mixing gain device configured to provide a fixed gain value to the center channel signal that is delayed in the first delay device in order to perform mixing between the center channel signal and each of the left and right channel signals; and a second mixing gain device configured to provide a fixed gain value to the center channel signal that is delayed in the second delay device in order to perform mixing between the center channel signal and each of the left and right surround channel signals.

15. The system of claim 14, further comprising:

first, second, third, fourth and fifth gain devices configured to respectively regulate gains of the left channel signal, the right channel signal, the center channel signal, the left surround channel signal and the right surround channel signal.

16. The system of claim 15, wherein the mixing device comprising:

a first mixing device configured to provide mixing between the left channel signal output by the first gain device and the center channel signal output by the first mixing gain device;

a second mixing device configured to provide mixing between the right channel signal output by the third gain device and the center channel signal output by the first mixing gain device;

a third mixing device configured to provide mixing between the left surround channel signal output by the fourth gain device and the center channel signal output by the second mixing gain device; and a fourth mixing device configured to provide mixing between the right surround channel signal output by the fifth gain device and the center channel signal output by the second mixing gain device.

17. The system of claim 11, wherein the calculating of the delay value includes calculating the distance $d_1$ in which the sound image of the center channel is moved from the center of the center channel speaker in the direction of the right channel speaker so as to satisfy $$d_1 = d_L \frac{\sin\theta'_s}{\sin\theta_y} - D/2,$$

when the center channel speaker becomes the left channel speaker and $d_L = d_C$,
where $\theta'_s$ is defined as $$\theta'_s = \frac{1}{2}\cos^{-1}\left(\frac{d_R^2 + d_C^2 - D^2}{2 \times d_R \times d_C}\right),$$

$\theta_y$ is defined as $$\theta_y = 180 - \theta'_s - \cos^{-1}\left(\frac{d_C^2 + D^2 - d_R^2}{2 \times d_C \times D}\right),$$

$d_L$ is a distance between the listener and the center of the center channel speaker, D is a distance between the center channel speaker and the left channel speaker, and D is the distance between the center channel speaker and the right channel speaker, $d_R$ is a distance between the listener and the right channel speaker and $d_C$ is a distance between the listener and the center channel speaker, wherein the delay value is determined from a difference value of a distance between the listener and the center channel speaker and a distance between the listener and each of the other channel speakers, and from a sound pressure difference between the center channel speaker and each of the other channel speakers, and a distance difference $d_{diff}$ is given by $d_{diff} = d_C - d_R$ and $t_{diff} = d_{diff}/v_s$, where $t_{diff}$ is a time difference and $v_s$ is a propagation velocity of a sound wave in air.

18. A method of reproducing a multi-channel audio signal, the method comprising:

calculating and applying a delay value of a center channel audio signal according to location relationships of a listener, a center channel speaker and other channel speakers, the calculating of the delay value including calculating a distance $d_1$ in which a sound image of the center channel is moved from a center of the center channel speaker in a direction of a right channel speaker so that calculating the distance $d_1$ is converted to calculating a distance of the listener to the center channel speaker as a distance of the listener to a left channel speaker;

calculating a signal delay and a sound level difference between the center channel speaker and the right channel speaker;

setting a sound pressure difference between the center channel speaker and each of the other channel speakers according to the distance which the sound image of the center channel is moved, as a threshold value;

converting a distance difference between the listener, the center channel speaker and the right channel speaker into a signal delay value within the threshold value;

mixing the audio signal of the time-delayed center channel with audio signals of left and right channels; and mixing the audio signal of the time-delayed center channel with audio signals of left and right surround channels, wherein the audio signal of the center channel mixed with audio signals of left and right channels is the same as the audio signal of the center channel mixed with audio signals of left and right surround channels.

19. The method of claim 18, wherein the calculating of the delay value includes calculating the distance $d_1$ in which the sound image of the center channel is moved from the center of the center channel speaker in a direction of the right channel speaker satisfies $$d_1 = d_L \frac{\sin\theta'_s}{\sin\theta_y} - D/2,$$

when the center channel speaker becomes the left channel speaker and $d_L = d_C$,
where $\theta'_s$ is defined as $$\theta'_s = \frac{1}{2}\cos^{-1}\left(\frac{d_R^2 + d_C^2 - D^2}{2 \times d_R \times d_C}\right),$$

$\theta_y$ is defined as $$\theta_y = 180 - \theta'_s - \cos^{-1}\left(\frac{d_C^2 + D^2 - d_R^2}{2 \times d_C \times D}\right),$$

$d_L$ is a distance between the listener and the center of the center channel speaker, D is a distance between the center channel speaker and the left channel speaker, and D is the distance between the center channel speaker and the right channel speaker, $d_R$ is a distance between the listener and the right channel speaker and $d_C$ is a distance between the listener and the center channel speaker, and a distance difference $d_{diff}$ is given by $d_{diff} = d_C - d_R$ and $t_{diff} = d_{diff}/v_s$, where $t_{diff}$ is a time difference and $v_s$ is a propagation velocity of a sound wave in air.

20. A non-transitory computer readable storage medium to store a computer program that causes a computer to execute a process of reproducing a multi-channel audio signal, the process comprising:

calculating a delay value of a center channel signal according to location relationships of a listener, a center channel speaker and other channel speakers, wherein the calculating of the delay value includes:

calculating a distance $d_1$ in which a sound image of the center channel is moved from a center of the center channel speaker in a direction of a right channel speaker so that calculating the distance $d_1$ is converted to calculating a distance of the listener to the center channel speaker as a distance of the listener to a left channel speaker;

calculating a signal delay and a sound level difference between the center channel speaker and the right channel speaker;

setting a sound pressure difference between the center channel speaker and each of the other channel speakers according to the distance which the sound image of the center channel is moved, as a threshold value;

regulating a time delay of the center channel signal according to the calculated delay value; and mixing the time-delay regulated center channel signal with other channel signals.

21. The non-transitory computer readable storage medium of claim 20, wherein the calculating of the delay value includes calculating the distance $d_1$ in which the sound image of the center channel is moved from the center of the center channel speaker in the direction of the right channel speaker so as to satisfy $$d_1 = d_L \frac{\sin\theta'_s}{\sin\theta_y} - D/2,$$

when the center channel speaker becomes the left channel speaker and $d_L = d_C$, where $\theta'_s$ is defined as $$\theta'_s = \frac{1}{2}\cos^{-1}\left(\frac{d_R^2 + d_C^2 - D^2}{2 \times d_R \times d_C}\right),$$

$\theta_y$ is defined as $$\theta_y = 180 - \theta'_s - \cos^{-1}\left(\frac{d_C^2 + D^2 - d_R^2}{2 \times d_C \times D}\right),$$

$d_L$ is a distance between the listener and the center of the center channel speaker, D is a distance between the center channel speaker and a left channel speaker, and D is a distance between the center channel speaker and the right channel speaker, $d_R$ is a distance between the listener and the right channel speaker and $d_C$ is a distance between the listener and the center channel speaker, and a distance difference $d_{diff}$ is given by $d_{diff} = d_C - d_R$ and $t_{diff} = d_{diff}/v_s$, where $t_{diff}$ is a time difference and $v_s$ is a propagation velocity of a sound wave in air.

22. A method of reproducing a multi-channel audio signal, the method comprising:

obtaining a delay value of a center channel signal according to relative locations of a listener, a center channel speaker and each of one or more other channel speakers with respect to each other, wherein the obtaining of the delay value includes:

calculating a distance by which a sound image of the center channel is moved from the center channel speaker to each of the one or more other channel speakers, calculating a sound pressure level difference between the center channel speaker and each of the one or more other channel speakers, setting the sound pressure level difference according to the distance which the sound image of the center channel is moved, as a threshold value, and converting a distance difference between the listener and the center channel speaker and between the listener and each of the one or more other channel speakers into the delay value within the threshold value;

regulating a time delay of the center channel signal according to the obtained delay value; and mixing the time-delay regulated center channel signal with other channel signals.

* * * * *